United States Patent [19]

Château

[11] 4,027,120

[45] May 31, 1977

[54] IGNITION DISTRIBUTOR HAVING CONTACT ADJUSTMENT MECHANISM

[75] Inventor: Louis Château, Rosny-sur-Bois, France

[73] Assignee: Ducellier & Cie., Paris Cedex, France

[22] Filed: Sept. 19, 1975

[21] Appl. No.: 614,887

[30] Foreign Application Priority Data

Sept. 24, 1974 France ..... 74.32126
Jan. 9, 1975 France ..... 75.00491

[52] U.S. Cl. ..... 200/31 A; 200/249; 200/286

[51] Int. Cl.[2] ..... H01H 1/34; H01H 19/62

[58] Field of Search ..... 200/19 A, 30 A, 31 A, 200/286, 249

[56] References Cited

UNITED STATES PATENTS

| | | | |
|---|---|---|---|
| 2,594,447 | 4/1952 | Kerr | 200/31 A |
| 2,640,891 | 6/1953 | Buck et al. | 200/31 A X |
| 2,820,858 | 1/1958 | Tompkins | 200/31 A |
| 3,444,339 | 5/1969 | Jukes | 200/31 A |
| 3,819,884 | 6/1974 | Janci | 200/31 A |

*Primary Examiner*—James R. Scott

[57] ABSTRACT

An ignition distributor for use in an internal combustion engine, the distributor having in known manner a fixed contact and a movable contact wherein there is provided a support for the fixed contact having a housing which contains a nut threadably engaged with an adjustment screw whereby angular divergence is permitted between the screw and said support for the fixed contact when the screw is rotated.

6 Claims, 4 Drawing Figures

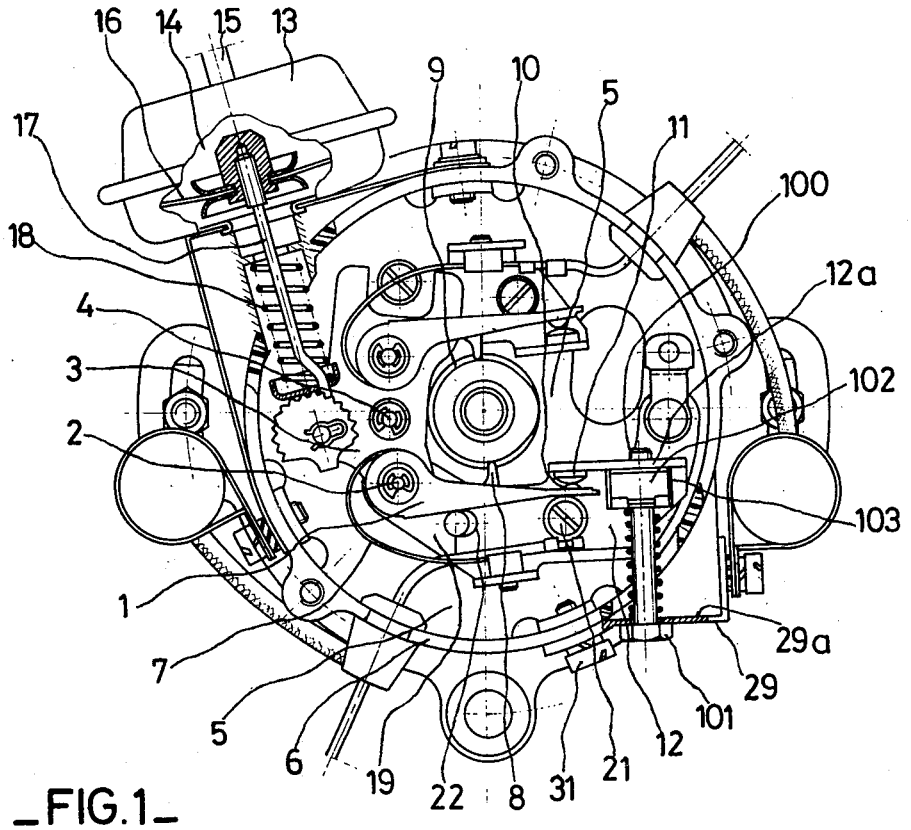
_FIG.1_
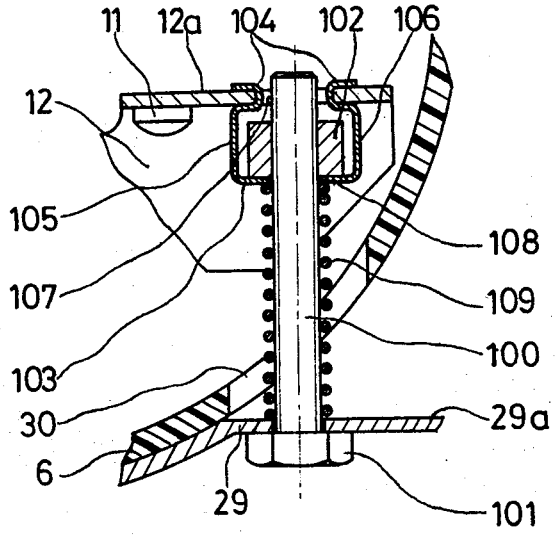
_FIG. 2_

IGNITION DISTRIBUTOR HAVING CONTACT ADJUSTMENT MECHANISM

The present invention relates to an ignition distributor for an internal combustion engine which may, or may not have a centrifugal regulator ensuring displacement of a contact breaker cam with respect to a contact breaker arm as a function of the speed of rotation, an ignition advance regulator controlled by a capsule which is in use connected to the depression in the inlet manifold of the associated engine, the regulator being connected to an advance lever carrying the contact breaker arm in order to turn it in the direction of ignition advance, the distributor however including means for adjusting the spacing of the contacts of the contact breaker which permit such adjustment being made from outside the distributor housing without taking off its head.

According to an ignition distributor described in French Pat. No. 1,566,469 such adjustment means are constituted by a movable plate which carries a support for the fixed contact of the contact breaker, which plate pivots about a shaft fixed to a plate carrying the contact breaker, which is itself rigid with the distributor housing. The angular movement of the movable plate is controlled from outside the housing by a screw which passes through the housing and which screws into the support for the fixed contact, thereby permitting the contact to be moved towards or away from the movable secured to the end of the contact breaker arm.

Although this device gives good results, it nevertheless has certain disadvantages. In fact, when the fixed contact is adjusted with respect to the movable contact by turning the screw, an angular divergence is produced between the screw and the support for the fixed contact.

This is due to the fact that the screw moves along an axis and the support for the fixed contact moves along the arc of a circle.

It is thus necessary to provide a certain play in the thread receiving the screw in order to permit the angular divergences. This can then lead to a rapid deterioration of the thread due to the vibrations to which the distributor is subjected.

One object of the present invention is to overcome this disadvantage.

In accordance with the invention, there is provided an ignition distributor having a fixed contact and a movable contact characterized in that a support for the fixed contact is provided with a housing in which pivots a nut threadably engaged with an adjustment screw in which a manner that it permits angular divergence between the screw and the support for the fixed contact when the screw is rotated.

A resilient member may be disposed coaxially on the screw so as to bear on the one hand, on a fixed portion of the housing and, on the other hand, on the fixed contact support.

The fixed contact support may have means by means of which the support is capable of moving angularly at a radius, the center of which coincides with the mean position of the pivotal axis of the contact breaker arm. This means may be constituted by a slot formed in the fixed contact support at a radius, the center of which coincides with the mean position of the pivotal axis of the contact breaker arm, and a screw passing through the slot which screws into the fixed plate and under the head of which is disposed a resilient member which, when the screw is tightened, is compressed onto the fixed contact support which is located on a shoulder of the screw in such a manner that the fixed contact support is held resiliently on the fixed plate.

The invention will now be more particularly described with reference to the accompanying drawings wherein:

FIG. 1 is a plan view of a distributor including two contact breakers, one of which (namely the lower one as shown) is provided with an example of an adjustment device according to the invention.

FIG. 2 is a view in section on a larger scale of the adjustment device seen in FIG. 1.

Figure 3:
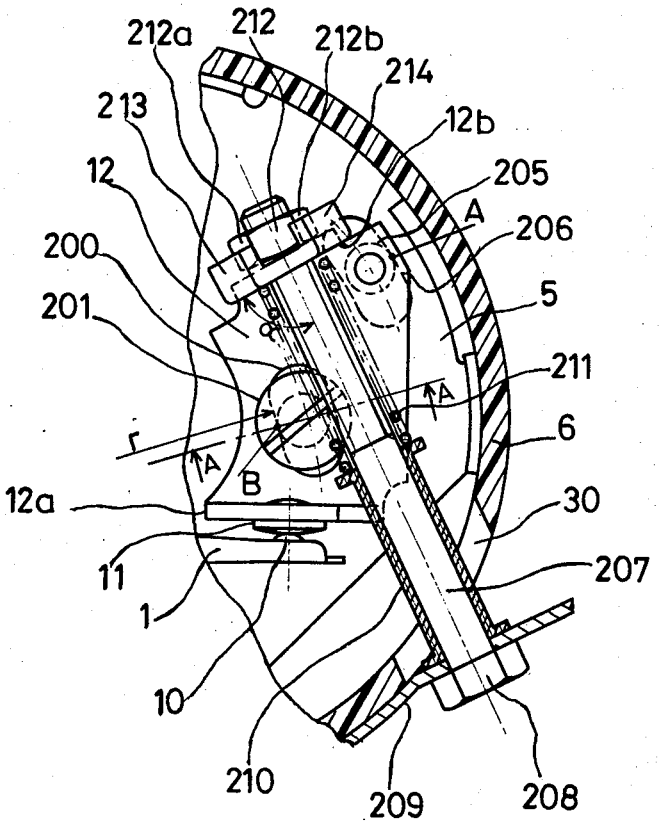
FIG. 3 is a partial plan view of a distributor provided with an alternative embodiment of an adjustment device according to the invention.

Referring to FIG. 1, the lower contact breaker shown therein has, in known manner, an arm 1 rotatably mounted about a shaft 2 rigid with an advance lever 3, itself rotatable about a pivot 4 rigid with a contact breaker carrying plate 5 fixed in a housing 6.

A spring 7 constantly pushes the insulated heel 8 of the arm 1 against a cam 9. At the end of the arm 1 is fixed a contact 10 co-operating with a fixed contact 11 secured to an arm **12*a* bent up at right angles from a support 12**. These two contacts are electrically connected in use in a manner known per se to the primary winding of an ignition coil.

There is also provided a depression capsule 13 secured to the outside of the housing 6, and which controls the ignition advance regulator, the capsule having in known manner a chamber 14 subjected via a pipe 15 to the inlet manifold depression of the engine, and a resilient membrane 16 at the center of which is fixed a rod 17 urged by a spring 18 in the opposite direction to that in which it is urged by the action of the depression on the membrane. The effect of the depression is transmitted, by means of the rod 17, to the advance lever 3, pivoting about the pivot 4 and driving the arm 1 which is itself articulated on the shaft 2 rigid with the advance lever 3.

The fixed contact support 12 is fixed on a movable plate 19 which pivots about a shaft (not shown) rigid with the contact breaker carrying plate 5, itself rigid with the housing 6. The above-mentioned pivotal axis of the movable plate 19 is located approximately coaxially with the shaft 2 about which pivots the arm 1. The contact 11 is rivetted on an arm bent up at right angles from the fixed contact support 12, which is itself fixed, by a screw 21, on the movable plate 19. The contact support 12 is positioned on the movable plate 19, being centered on an aperture 22.

When the contact breaker is adjusted, and is described in the aforesaid French Pat. No. 1,566,469, the movable plate 19 is displaced angularly within the limits of the edges of a slot (not shown) formed in the contact breaker carrying plate 5, into which extends the end of the screw 21.

The angular displacement of the movable plate 19 carrying the fixed contact support 12 is controlled from outside the housing 6 by an adjustment screw 100 of which the head 101 bears on a bracket 29 secured by means of a screw 31, to the periphery of the housing 6 approximately opposite to an opening 30 in the housing.

The adjustment screw 100 passes through the bracket 29 and through the opening 30 in the housing 6 and screws into a square nut 102 located in a housing 103 made rigid with the arm 2*a* of the fixed contact support 12 (See FIG. 2). The housing 103 is of a shape corresponding to the nut 102 but of slightly larger dimensions, so as to prevent rotation of the nut, whilst permitting a predetermined play as a function of the maximum angular divergence liable to occur between the screw 100 and the fixed contact support 12 when the latter is adjusted.

The housing 103 is made rigid with the fixed contact support 12 by means of two resilient lugs 104 which extend from two of its opposed lateral faces 105 and 106 and which are shaped so as to resiliently anchor against the edges of a slot 107 formed in the fixed contact support 12. Furthermore, the housing 103 is provided with a slot 108 permitting the passage of the adjustment screw 100.

The axial retention of the adjustment screw 100 is ensured by a spring 109 disposed coaxially on the said screw and bearing, on the one hand on the internal surface 29*a* of the bracket 29 and, on the other hand, on the housing 103. The effect of this is that the head of the screw 101 constantly bears on the bracket 29.

The adjustment device which has just been described has the advantage of permitting the adjustment of the spacing of the contacts of the contact breaker whilst the distributor is mounted on the engine without removing the distributor head.

For this, it is sufficient, using any tool (such as a screwdriver if the adjustment screw 100 has a suitable slot), to turn the screw in one direction or the other in such a manner that, screwing or unscrewing it in the nut 102, it causes the angular displacement of the movable plate 19 with respect to its pivotal axis 20, and as a result causes the movement of the fixed contact 11 rigid with the contact support 12, itself rigid with the movable plate 19, towards or away from the contact 10 fixed to the end of the movable arm 1.

Figure 4:
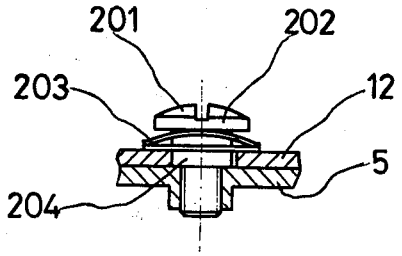
FIG. 4 is a view in section along the line A—A of FIG. 3.

According to another embodiment shown in FIGS. 3 and 4, when the fixed contact support 12 is adjusted, it is capable of moving angularly at a radius *r* of which the center coincides with the mean position of the pivotal axis of the contact breaker arm 1, by virtue of means which are constituted by a slot 200 formed in the fixed contact support 12 at the radius *r*, a screw 201 passing through the slot 200 and screwing into the fixed plate 5. Under the head 202 of screw 201 is disposed a resilient washer 203 (see FIG. 4) which, when the screw 201 is tightened is compressed onto the fixed contact support 12 which is located on a shoulder 204 formed under the head 202, in such a way that the fixed contact support 12 bears resiliently on the fixed plate 5, so that it can move during an adjustment operation, whilst being held against movement sufficiently during operation.

The contact support 12 is also positioned and centered on the fixed plate 5 by a pin 205 extending into a slot 206 formed in fixed plate 5.

The angular movement of the contact support 12 in this embodiment is controlled from outside the housing 6 by an adjustment screw 207 of which the head 208 bears on a bracket 209 fixed on the periphery of the housing 6 opposite to an opening 30 in housing.

The adnjustment screw 207 has a sleeve 210 bearing at one of its ends on the bracket 209 and a spring 211 bearing, on the one hand on the other end of the sleeve and, on the other hand on one arm 12*b* of the support 12, arranged approximately opposite to the arm 12*a* of the same support 12. The adjustment screw 207 passes through a slot (not shown) formed in the arm 12*b* and screws into a self-locking nut 212 bearing on the arm 12*b*.

In order to prevent rotation of the nut 212 during turning of the screw 207, two lugs 213 and 214, made in one piece with the support 12, partially enclose the nut 212, bearing on two faces 212*a* and 212*b* of the nut 212.

As shown in FIG. 3, the vertical plane of the arm 12*b* of the support 12 forms with the axis of the scew 207 an angle $\alpha$ such as to permit some misalignment of the nut 212 and the spring 211 at either side of arm 12*b*, at opposed points, in such a way as to apply to the contact support 12 a force tending to return it always to the same side determined by the direction of the angle $\alpha$, and defined by the points of contact B and A respectively of the screw 201 in the slot 200 and the centering pin 205 in the slot 206, in order to ensure automatic and permanent taking up of play in operation and during adjustment of the support 12.

I claim:

1. An ignition distributor with contact adjustment means comprising: a housing means, a fixed contact and a movable contact, a support for said fixed contact within said housing means a housing on said support, a nut mounted in said housing so as to be non-rotatable relative thereto, and an adjustment screw threadably engaged with said nut and fixedly retained and rotatably adjustable with respect to said housing means, said nut and said housing being spaced from each other so as to permit angular movement of said housing about an axis transverse to the longitudinal axis of said adjustment screw when said screw is rotated.

2. An ignition distributor according to claim 1, comprising a resilient member disposed co-axially on said screw, and a fixed abutment, said resilient member bearing on said fixed abutment and said support.

3. An ignition distributor according to claim 1, comprising a contact breaker arm movable about a pivotal axis within said housing means and adapted to occupy a plurality of positions including a mean position, and wherein said support has means permitting said support to move angularly at a radius the center of which coincides with said mean position.

4. An ignition distributor according to claim 3, wherein said last-mentioned means comprises a slot formed in said support at said radius, fixed means in said distributor, screw means passing through said slot and threadedly received in said fixed means, said screw means having a head, a resilient means disposed under said head, whereby when said screw means is tightened said resilient means is compressed onto said support and said support is resiliently held on said first means.

5. An ignition distributor according to claim 1, comprising arm means connected to said support and extending at right angles to said support and having a slot, a self-locking nut bearing on said arm means, said screw means passing through said slot and screwing into said self-locking nut.

6. An ignition distributor according to claim 5, wherein a vertical plane extending through said arm of said support is inclined with respect to the longitudinal axis of said screw means passing through said slot in said arm means whereby said self-locking nut is misaligned with respect to said arm means.

* * * * *